US009024756B2

(12) United States Patent
Kleppe

(10) Patent No.: US 9,024,756 B2
(45) Date of Patent: May 5, 2015

(54) IMMEDIATE DETECTION SYSTEM AND METHOD THEREOF

(71) Applicant: SENSIT Technologies, Valparaiso, IN (US)

(72) Inventor: John Scott Kleppe, Union Mills, IN (US)

(73) Assignee: J And N Enterprises Inc., Valparaiso, IN (US)

( * ) Notice: Subject to any disclaimer, the term of this patent is extended or adjusted under 35 U.S.C. 154(b) by 0 days.

(21) Appl. No.: 13/852,626

(22) Filed: Mar. 28, 2013

(65) Prior Publication Data

US 2014/0139336 A1 May 22, 2014

Related U.S. Application Data

(60) Provisional application No. 61/616,461, filed on Mar. 28, 2012.

(51) Int. Cl.

| | |
|---|---|
| ***G08B 17/00*** | (2006.01) |
| ***G08B 17/10*** | (2006.01) |
| ***G08B 21/14*** | (2006.01) |

(52) U.S. Cl.

CPC ..... *G08B 17/10* (2013.01); *G08B 21/14* (2013.01)

(58) Field of Classification Search

CPC ..... G08B 17/10

USPC ..... 340/502, 505, 506, 508, 517, 521, 531, 340/540, 541, 628, 630; 356/336, 338; 436/151; 700/284; 702/138, 188

See application file for complete search history.

(56) References Cited

U.S. PATENT DOCUMENTS

| | | | | |
|---|---|---|---|---|
| 6,963,817 | B2 * | 11/2005 | Ito et al. | 702/138 |
| 7,263,459 | B2 * | 8/2007 | Ito et al. | 702/138 |
| 7,518,723 | B2 * | 4/2009 | Adams et al. | 356/338 |
| 7,551,279 | B2 * | 6/2009 | Adams et al. | 356/338 |
| 7,629,880 | B2 * | 12/2009 | Stilp et al. | 340/508 |
| 7,656,287 | B2 * | 2/2010 | Albert et al. | 340/521 |
| 7,802,571 | B2 * | 9/2010 | Tehrani | 128/204.23 |
| 2006/0250260 | A1 * | 11/2006 | Albert et al. | 340/628 |
| 2013/0017317 | A1 * | 1/2013 | Ring et al. | 427/8 |

* cited by examiner

*Primary Examiner* — Van Trieu

(74) *Attorney, Agent, or Firm* — Hartman Global IP Law; Gary M. Hartman; Michael D. Winter

(57) ABSTRACT

Systems and methods thereof for detecting at least one material in an environment prior to the environment reaching levels deemed dangerous by conventional monitors and standards includes at least one sensor adapted to measure a level of the at least one material in the environment surrounding the sensor, at least one notification device adapted to produce a signal, and a memory comprising a preprogrammed level of the at least one material in the environment. The system is programmed with a minimum notification level of the at least one material in the environment that is below the preprogrammed level and is adapted to notify a user with the signal if the level exceeds the minimum notification level. The frequency and/or amplitude of the signal is changed as the level approaches the preprogrammed level.

23 Claims, 1 Drawing Sheet

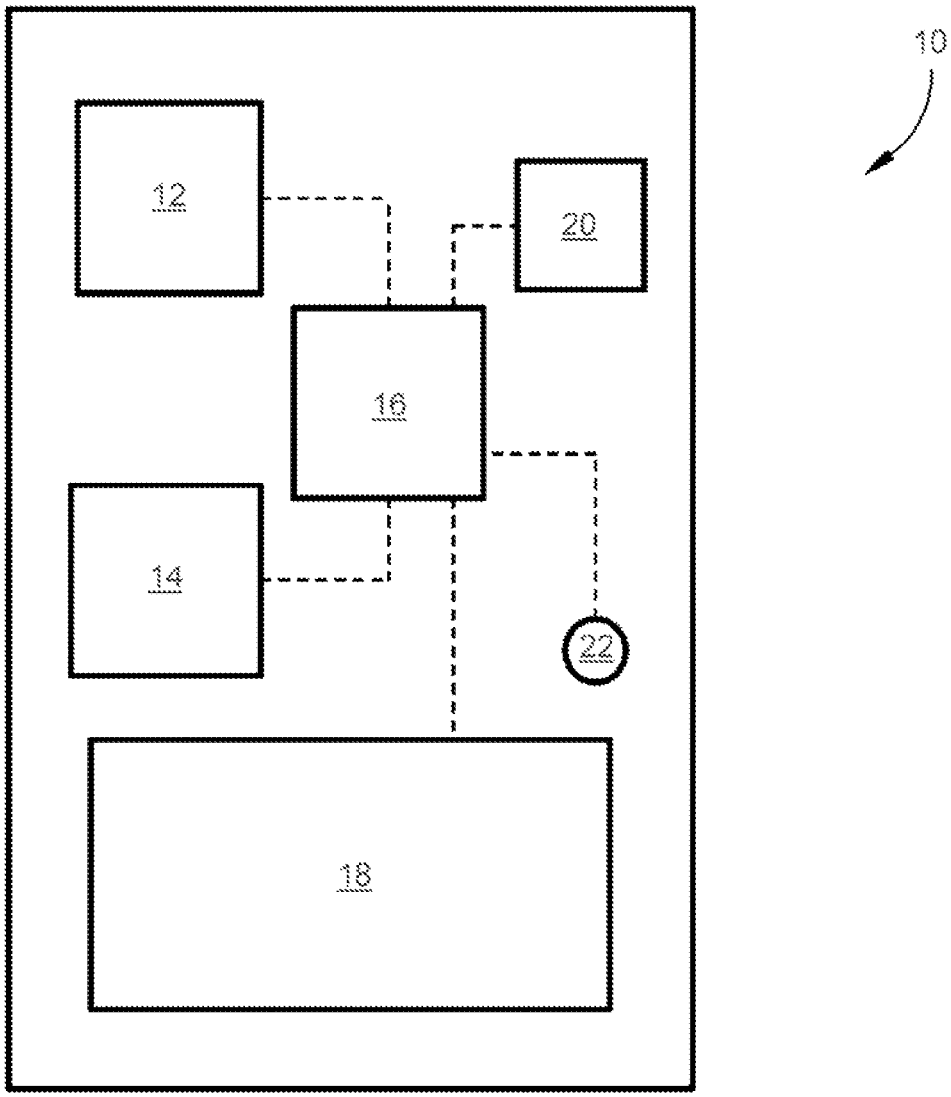
10
12
20
16
14
22
18

IMMEDIATE DETECTION SYSTEM AND METHOD THEREOF

CROSS REFERENCE TO RELATED APPLICATIONS

This application claims the benefit of U.S. Provisional Application No. 61/616,461, filed May 28, 2012, the contents of which are incorporated herein by reference.

BACKGROUND OF THE INVENTION

The present invention generally relates to sensors and detection systems. More particularly, this invention relates to a system and method thereof which alerts users of a changing environment based on the rate of change of a parameter being sensed, regardless of the actual level of that parameter.

Personal gas monitors are gas detection instruments used to identify the presence of a gas or vapor in an environment. These monitors are generally portable and carried by users to warn them of hazardous gases as the users work in environments that may contain unknown amounts of hazardous gases, for example, if the user was investigating and/or repairing a gas leak. Personal gas monitors have a variety of applications for use with fire and emergency service personnel, confined space entry, utilities, water treatment plants, mining, steel mills, police, hazmat, shipping, transportation, telecom, refineries, offshore drilling platforms, petrochemical plants, parking garages, pharmaceuticals, manufacturing, HVAC, laboratories and any industries where accidental leakage of gas or vapors can endanger workers.

Gas monitors have sensors that detect the presence and level of a gas in a surrounding environment, and, if a level of the gas exceeds a level, typically indicated as a percentage of the entire environment predetermined to be hazardous to a human, the gas monitor alerts the user, for example, with an audible and/or visible alarm. However, currently available personal gas monitors may be limited as they can only provide a warning to the user once the level of the gas in the environment reaches the predetermined level. Therefore, the user may be exposed to hazardous gases that are at levels below prescribed levels, yet may still be hazardous to the user based on the duration of the exposure or the physical condition of the user, or that may later be determined to be hazardous. Furthermore, the user may remain unaware of a rapid increase in the level of a gas in the environment, reducing the user's ability to escape prior to the environment becoming dangerous.

In view of the above, there is a need for a system which can alert users of a potentially dangerous environment prior to the environment reaching levels deemed dangerous by conventional monitors and standards.

BRIEF DESCRIPTION OF THE INVENTION

The present invention provides a method and systems suitable for alerting users of prior to the environment reaching levels deemed dangerous by conventional monitors and standards.

According to a first aspect of the invention, a system for detecting at least one material in an environment includes at least one sensor adapted to measure a level of the at least one material in the environment surrounding the sensor, at least one notification device adapted to produce a signal, and a memory comprising a preprogrammed level of the at least one material in the environment. The system is programmed with a minimum notification level of the at least one material in the environment that is below the preprogrammed level and is adapted to notify a user with the signal if the level exceeds the minimum notification level. The frequency and/or amplitude of the signal is changed as the level approaches the preprogrammed level.

According to a second aspect of the invention, a method for detecting at least one material in an environment around a user includes programing a minimum notification level of the at least one material in the environment that is below a preprogrammed level, measuring a level of the at least one material in the environment, notifying the user with a signal if the level exceeds the minimum notification level, and changing the frequency and/or amplitude of the signal as the level approaches the preprogrammed level.

According to a third aspect of the invention, a system for detecting at least one material in an environment includes at least one sensor adapted to measure a level of the at least one material in the environment surrounding the sensor and at least one notification device adapted produce a signal. The system determines if a change occurs in the level of the at least one material and causes the at least one notification device to notify a user with the signal if the change or a rate of the change exceeds a predetermined threshold.

A technical effect of the invention is the ability to notify a user if the level of a measured material in the surrounding environment prior to the environment reaching levels deemed dangerous by conventional monitors and standards. In particular, it is believed that, by alerting the user to if the level of a measured material exceeds a user defined minimum notification level, the user may be warned of potential hazards prior to the environment reaching levels that may be dangerous to humans.

Other aspects and advantages of this invention will be better appreciated from the following detailed description.

BRIEF DESCRIPTION OF THE DRAWINGS

FIG. 1 schematically represents a detection system in accordance with an aspect of the invention.

DETAILED DESCRIPTION OF THE INVENTION

The present invention is generally applicable to systems and methods of sensing and detecting a presence of gases, vapors, or other materials in an environment. Specifically, the present invention relates to systems and methods which alert users of a changing environment based on a minimum parameter being sensed that is lower than parameters deemed dangerous by conventional monitors and standards and/or the rate of change of a level of the parameter being sensed, regardless of the absolute level of that parameter in the environment. The present invention may have applications for use with fire and emergency service personnel, confined space entry, utilities, water treatment plants, mining, steel mills, police, hazmat, shipping, transportation, telecom, refineries, offshore drilling platforms, petrochemical plants, parking garages, pharmaceuticals, manufacturing, HVAC, laboratories and any industries where accidental leakage of gas or vapors can endanger workers.

FIG. 1 represents an immediate detection system 10 comprising a sensor 12 adapted to detect the presence of gases, vapors, or other materials, a notification device 14 for alerting the user of the presence of the gases, vapors, or other materials, a silencing button 22 for silencing the notification device 14, and a microprocessor 16 in communication with the sensor 12 and notification device 14 that interconnects the components of the system 10. The microprocessor 16 may be any device capable of operating the system 10 such as, but not limited to, a central processing unit (CPU), an application-specific integrated circuit (ASIC), an application-specific instruction-set processor (ASIP), circuit board, or similar device. The system 10 includes an optional display 18 in communication with the microprocessor 16 to provide information relating to the environment and/or settings of the system 10 to the user. The system 10 includes a memory 20 in communication with the microprocessor 16 and/or the sensor 12 where predetermined levels of the gases, vapors, or other materials may be permanently stored by the manufacturer (i.e., the limits set by industry standards) and/or temporarily stored by the user.

The system 10 is primarily software driven and adapted to determine a level of the material being sensed in the environment. The system 10 is preferably programmable to allow the user to selectively set threshold levels (minimum notification levels) that are less than conventional and/or industry standards and the microprocessor 16 is preferably adapted to determine if the level in the environment exceeds the minimum notification level based on the output of the sensor 12. By allowing the user to program minimum notification levels, the user can be warned of a potential hazard prior to the environment becoming hazardous according to conventional and/or industry standards (referred to hereinafter as an alarm level). For example, if the user enters an environment that contains a particular gas that by conventional or industry standards is dangerous if it reaches a level of ten percent or more of the environment, that is, an alarm level of ten percent, a conventional gas monitor may warn the user when the gas reaches a level of ten percent of the environment. With the system 10, the user can program the system 10 to warn the user if the gas reaches a level of less than ten percent. In this example, if the user programs the system 10 to alert the user if the gas reaches fifty percent of the alarm level of ten percent, then if the gas in the environment reaches the predetermined level, that is, five percent of the environment (fifty percent of the ten percent alarm level), the system 10 will notify the user of this change in the environment. Similarly, if the system 10 is set to alert the user if the gas reaches ten percent of the alarm level, the system 10 will alert the user if the sensor 12 detects the gas at an level of one percent in the environment (ten percent of the ten percent alarm level). Preferably, the alarm levels of all materials being sensed by the system 10 are preprogrammed in the memory 20.

Alternatively or in addition to the above functionality, the system 10 may be adapted to notify the user of an increase in the level of the measured gas in the environment regardless of an alarm level that may have be preprogrammed into the memory of the system 10 or stored by the user into the memory of the system 10. The system 10 may be adapted to sense changes and preferably rates of changes of a particular material (gas, vapor, or other material) in an environment being sensed. By detecting changes in the level of the material in the environment rather than solely the absolute level in the environment, the user can be warned of a potential hazard prior to the environment becoming hazardous according to conventional and/or industry standards. The microprocessor 16 is preferably adapted to determine whether an increase has occurred in the level of the gas in the environment based on the output of the sensor 12. Upon detecting that an increase in the level of the gas has occurred, the microprocessor 16 can transmit a signal to the notification device 14 causing the notification device 14 to warn the user of the increase in the gas if that increase (for example, based on percentage points) or the rate of increase (for example, percentage points versus time) exceeds a threshold that may have been permanently stored in the memory by the manufacturer (i.e., limits set by industry standards) or a level temporarily stored in the memory by the user. For example, the microprocessor 16 may be programmed to cause the notification device 14 to alert the user if the level of the gas increases by a certain amount of percentage points from a previous measurement performed by the sensor 12. Alternatively or in addition, the microprocessor 16 may be programmed to cause the notification device 14 to alert the user if the measured rate of increase exceeds a predetermined threshold.

The device 14 for alerting the user of the presence of the gas, vapor, or other material, may be any device suitable for producing a signal capable of warning the user including, but not limited to, speakers, magnetic sounders, lights and/or vibration devices. Preferably, the device 14 is adapted to emit a repeatable sound and can alert the user by emitting an audible tick or other signal. This tick can preferably be silenced by the user, for example, with the silencing button 22, but as the gas level increases in the environment and/or gets closer to alarm level, the tick may increase in frequency and/or amplitude. In preferred embodiments, each subsequent tick rate increase can also be silenced by the user, but every time the gas percentage increases by a predetermined level the system 10 preferably automatically resumes emitting the audible tick, regardless of whether or not the tick was previously silenced by the user. The system 10 may comprise multiple devices 14 of different types to ensure that warnings from the system 10 are noticed by the user in a variety of working environments. In such case, the above-described increase in frequency and/or amplitude of the repeatable sound can be substituted or accompanied by activation of other types of devices 14, such as vibrations or flashing lights. For example, one or more devices 14 may produce noises, vibrations, lights, any other signal, and/or combinations thereof and the frequency and/or amplitude of one, some, or all of these signals may change as the gas level approaches the alarm level.

The sensor 12 may be any type of sensor suitable for measuring the particular gas(es), vapor(s), or other material(s) that the user desires to measure in an environment. Nonlimiting examples of materials include hydrogen sulfide, hydrogen cyanide, oxygen, carbon monoxide, chlorine, nitric oxide, phosphine, sulfur dioxide, and combustible gases. The system 10 may comprise one or more sensors 12 adapted to detect one or more gases, vapors, or other materials in the environment.

The display 18 may be any type of optical display such as a liquid crystal display or light-emitting diode screen. Preferably, the display 18 is adapted to show the user levels or percentages of the gases in the environment detected by the sensor 12 as well as percentages of hazardous gases in relation to their respective alarm levels. For example, if the system 10 is set to fifty percent of the alarm level and a measured gas having an alarm level of ten percent in the environment is at eight percent, the system 10 can display eighty percent accordingly, since the gas is eighty percent of the way to the alarm level.

The system 10 may comprise other components and features common to gas sensing instruments known in the art such as filters, functional buttons/controls, and belt clips. Preferably, the system 10 is a personal gas monitor adapted to be portable and carried or secured to a user as the user enters and thereafter may remain in an environment where an accidental leakage of gas, vapors, or other materials might endanger the user.

With this invention, warnings to the user are preferably based on user programmed minimum notification levels that are less than conventional and/or industry standards. Alternatively or in addition, the warnings may be based on sensing a change in the level or a rate of change of the level of a material in the environment, and not the absolute level of that material itself. The rate of change may trigger the notification device 14 regardless of the actual level of the material sensed. Therefore, the system can be capable of providing the earliest possible warning to the user.

While the invention has been described in terms of specific embodiments, it is apparent that other forms could be adopted by one skilled in the art. For example, the physical configuration of the system 10 could differ from that shown, and materials and processes other than those noted could be used. Therefore, the scope of the invention is to be limited only by the following claims.

The invention claimed is:

1. A system for detecting at least one material in an environment, the system comprising:

at least one sensor adapted to measure a level of the at least one material in the environment surrounding the sensor;

at least one notification device adapted to produce a repeating signal having a frequency and amplitude;

a memory comprising a preprogrammed level of the at least one material in the environment; and means for programing a minimum notification level of the at least one material in the environment that is below the preprogrammed level;

wherein the system is adapted to notify a user with the repeating signal if the level of the at least one material in the environment exceeds the minimum notification level by producing the repeating signal as long as the level exceeds the minimum notification level and changing the frequency and/or amplitude of the repeating signal in response to the level increasing and approaching the preprogrammed level.

2. The system of claim 1, further comprising means for determining if the level of the at least one material in the environment exceeds the minimum notification level.

3. The system of claim 2, wherein the determining means comprises a microprocessor in communication with the sensor, the notification device, and memory.

4. The system of claim 2, wherein the at least one material in the environment is a gas or vapor.

5. The system of claim 1, further comprising means for determining a rate of change of the level of the material in the environment, wherein the system is adapted to notify the user with the repeating signal if the rate of change exceeds a predetermined threshold.

6. The system of claim 1, further comprising means for stopping the repeating signal.

7. The system of claim 6, wherein the system is adapted to cause the repeating signal to automatically resume after the repeating signal has been stopped if the level of the material subsequently changes in the environment.

8. The system of claim 1, further comprising a display in communication with the microprocessor and adapted to show the user the level of the material in the environment.

9. The system of claim 1, further comprising a display in communication with the microprocessor and adapted to show the user a percentage of the material in the environment relative to an alarm level of the material.

10. A method for detecting at least one material in an environment around a user, the method comprising:

programing a minimum notification level of the at least one material in the environment that is below a preprogrammed level;

measuring a level of the at least one material in the environment;

notifying the user with a repeating signal having a frequency and amplitude if the level of the at least one material in the environment exceeds the minimum notification level by producing the repeating signal as long as the level exceeds the minimum notification level; and changing the frequency and/or amplitude of the repeating signal in response to the level increasing and approaching the preprogrammed level.

11. The method of claim 10, further comprising determining if the level of the at least one material in the environment exceeds the minimum notification level.

12. The method of claim 10, further comprising measuring a rate of change of the level of the material in the environment and notifying the user with the repeating signal if the rate of change exceeds a predetermined threshold.

13. The method of claim 10, wherein the repeating signal can be stopped by the user.

14. The method of claim 13, further comprising resuming the repeating signal after the repeating signal has been stopped by the user if the level of the material subsequently changes in the environment.

15. The method of claim 10, further comprising displaying an level of the material in the environment to the user.

16. The method of claim 10, further comprising displaying a percentage of the material in the environment relative to an alarm level of the material to the user.

17. The method of claim 10, wherein the at least one material in the environment is a gas or vapor.

18. A system for detecting at least one material in an environment, the system comprising:

at least one sensor adapted to measure a level of the at least one material in the environment surrounding the sensor;

at least one notification device adapted to produce a repeating signal having a frequency and amplitude; and means for determining if a change occurs in the level of the at least one material;

wherein the determining means causes the at least one notification device to notify a user with the repeating signal if the change or a rate of the change of the level of the at least one material exceeds a first predetermined threshold, and causes the at least one notification device to change the frequency and/or the amplitude of the repeating signal in response to the change or the rate of the change of the level increasing and approaching a second predetermined threshold that is above the first predetermined threshold.

19. The system of claim 18, further comprising means for stopping the repeating signal.

20. The system of claim 19, wherein the system is adapted to cause the repeating signal to automatically resume after the repeating signal has been stopped if the level of the material subsequently changes in the environment.

21. The system of claim 18, further comprising a display in communication with the microprocessor and adapted to show the user the level of the material in the environment.

22. The system of claim 18, further comprising a display in communication with the microprocessor and adapted to show the user a percentage of the material in the environment relative to an alarm level of the material.

23. The system of claim 18, wherein the at least one material in the environment is a gas or vapor.

* * * * *